US006874253B2

(12) United States Patent
Hollis-Lorent

(10) Patent No.: US 6,874,253 B2
(45) Date of Patent: Apr. 5, 2005

(54) FOOTWEAR FOR FEET BEAUTIFICATION

(76) Inventor: Katrina Hollis-Lorent, 9040 Harratt St., #26, Los Angeles, CA (US) 90069

( * ) Notice: Subject to any disclaimer, the term of this patent is extended or adjusted under 35 U.S.C. 154(b) by 29 days.

(21) Appl. No.: 10/396,755

(22) Filed: Mar. 24, 2003

(65) Prior Publication Data

US 2004/0187345 A1 Sep. 30, 2004

(51) Int. Cl.[7] ..... A43B 5/08; A43B 1/10; A43B 1/12; A43B 7/00

(52) U.S. Cl. ..... 36/9 R; 36/8.1; 36/4; 36/55

(58) Field of Search ..... 36/141, 7.1 R, 36/73, 7.1 A, 8.1, 4, 55, 10, 9 R; 604/304, 308; 602/48, 66, 62, 75; 128/882, 893; 2/239

(56) References Cited

U.S. PATENT DOCUMENTS

| | | | | | |
|---|---|---|---|---|---|
| 850,603 | A | * | 4/1907 | Reiter | 36/8.1 |
| 1,257,086 | A | * | 2/1918 | Marcellus | 36/2.6 |
| 1,748,607 | A | * | 2/1930 | Jarrett | 36/7.1 R |
| 1,980,486 | A | * | 11/1934 | King et al. | 36/8.1 |
| 2,154,662 | A | | 4/1939 | Bucks | |
| 2,248,303 | A | * | 7/1941 | Morgenroth et al. | 2/239 |
| 2,400,023 | A | * | 5/1946 | Potter | 36/141 |
| 2,649,588 | A | | 8/1953 | Kantor | |
| 2,658,510 | A | * | 11/1953 | Hilton | 128/893 |
| 2,771,691 | A | | 11/1956 | Luchs | |
| 2,896,339 | A | | 7/1959 | Rabinowitz | |
| 3,148,378 | A | | 9/1964 | Tibbitts | |
| 3,148,463 | A | | 9/1964 | Tibbitts | |
| 3,324,580 | A | * | 6/1967 | Baxter | 36/8.1 |
| 3,380,178 | A | | 4/1968 | Haig | |
| 4,296,499 | A | | 10/1981 | Patterson et al. | |
| 4,616,428 | A | * | 10/1986 | Leger | 36/7.1 R |
| 4,649,910 | A | * | 3/1987 | Poenitsch | 602/62 |
| 4,811,499 | A | | 3/1989 | Jensen | |
| 5,353,524 | A | | 10/1994 | Brier | |
| 5,473,788 | A | * | 12/1995 | Aragona | 36/8.1 |
| 5,682,617 | A | | 11/1997 | Tumas | |
| 5,724,753 | A | | 3/1998 | Throneburg et al. | |
| 5,746,013 | A | | 5/1998 | Fay, Sr. | |
| 6,393,734 | B1 | | 5/2002 | Ou | |
| 6,742,289 | B2 | * | 6/2004 | Celmo | 36/141 |

* cited by examiner

*Primary Examiner*—Anthony Stashick
(74) *Attorney, Agent, or Firm*—Knobbe Martens Olson & Bear LLP

(57) ABSTRACT

An apparatus comprises a disposable inner footwear adapted for receiving a foot. The inner footwear is made from a plastic material and having a front portion, a heel portion, and an upper foot covering portion. The upper foot covering portion is adapted to be wrapped over the foot.

14 Claims, 7 Drawing Sheets

FOOTWEAR FOR FEET BEAUTIFICATION

FIELD OF THE INVENTION

The present invention relates generally to footwear, and relates particularly to footwear configured to promote feet beautification.

BACKGROUND OF THE INVENTION

Shoe inserts have been proposed for various applications, but many of the inserts suffer from drawbacks. For example, many conventional shoe inserts are directed principally to medicinal uses or odor reduction, and are not directed to foot beautification. In addition, many shoe inserts are difficult to size appropriately and do not provide the user with footwear having an attractive outward appearance. Further, many shoe inserts only contact the sole and heel of the foot and inadequately cover the upper portions of the foot.

SUMMARY OF THE INVENTION

In accordance with the foregoing, it is desired to develop an article of footwear capable of beautifying the feet and promoting healthy skin on the feet. As used herein "beautifying" refers to the process of making the skin more visually attractive, soft to the touch, and/or providing the skin with a more healthy appearance. Embodiments of the footwear are, for example, comfortable, convenient to use, and capable of being manufactured inexpensively. In addition, certain embodiments of the footwear described herein provide advantageous cosmetic and therapeutic effects to most or all of the surface of the foot, such as by allowing creams, ointments, lotions and/or other medicaments to be held in close contact with the skin. Other embodiments of the present invention are configured to have an attractive outwardly appearance such as can be created using visually appealing color schemes, ornamental designs and decorations. Still other embodiments are configured to provide the user with comfortable footwear that can be worn to bed whilst performing a foot beautification treatment.

According to one embodiment of the present invention, an apparatus comprises a disposable inner footwear adapted for receiving a foot. The inner footwear is made from a plastic material and has a toes portion, a heel portion, and upper and lower foot covering portions. The upper foot covering portion is adapted to be wrapped over the foot.

According to another embodiment of the present invention, a method for beautifying feet comprises disposing a lotion over a foot. The foot has at least one toe and a heel. The method further comprises inserting the foot into a disposable inner footwear. The at least one toe is housed in a front pouch, the heel is surrounded by a plurality of heel walls or sidewalls, and a plurality of top flaps are wrapped around and over the sides and the top of the foot. The method further comprises covering the inner footwear with an outer bootie or slipper having an ankle opening. The method further comprises adjusting the ankle opening such that the ankle opening fits securely over an upper portion of the foot.

According to another embodiment of the present invention, a foot beautification kit comprises a disposable inner footwear adapted for receiving the foot. The inner footwear is made from a plastic material. The inner footwear has a pouch covering the toes and at least a portion of the top foot, heel walls or sidewalls positioned opposite the front pouch, and a plurality of top flaps adapted to be wrapped over the foot. The foot beautification kit further comprises an outer bootie or slipper configured to be placed over the inner footwear. The outer bootie or slipper has an adjustable-width ankle opening configured to wrap around an upper portion of the foot. The foot beautification kit further comprises instructions for using the inner footwear and the outer bootie or slipper to beautify feet. Feet beautification is accomplished by placing a lotion on the feet, and then placing the feet in the inner footwear and the outer bootie or slipper. The inner footwear and the outer bootie or slipper can be worn overnight.

BRIEF DESCRIPTION OF THE DRAWINGS

Embodiments of the present invention are described below with reference to the following figures, which are intended to be illustrative and not limiting.

DETAILED DESCRIPTION OF PREFERRED EMBODIMENTS

As described above, it is desired to develop an article of footwear capable of beautifying the feet, and of promoting healthy skin on the feet. The foot beautification system described herein addresses these and other needs. As described in greater detail below, an exemplary embodiment of a foot beautification system comprises an inner footwear and an outer bootie or slipper. The inner footwear is configured to allow creams, ointments, lotions and/or other medicaments to be retained in close contact with the skin, while the outer bootie or slipper is configured to assist in securing the inner footwear over the foot during an activity such as sleeping or lounging. In certain embodiments, the outer bootie or slipper is also configured to provide a visually attractive outwardly appearance. Thus, for example, the outer bootie or slipper can have attractive design cues that are feminine or masculine as desired.

Figure 1A:
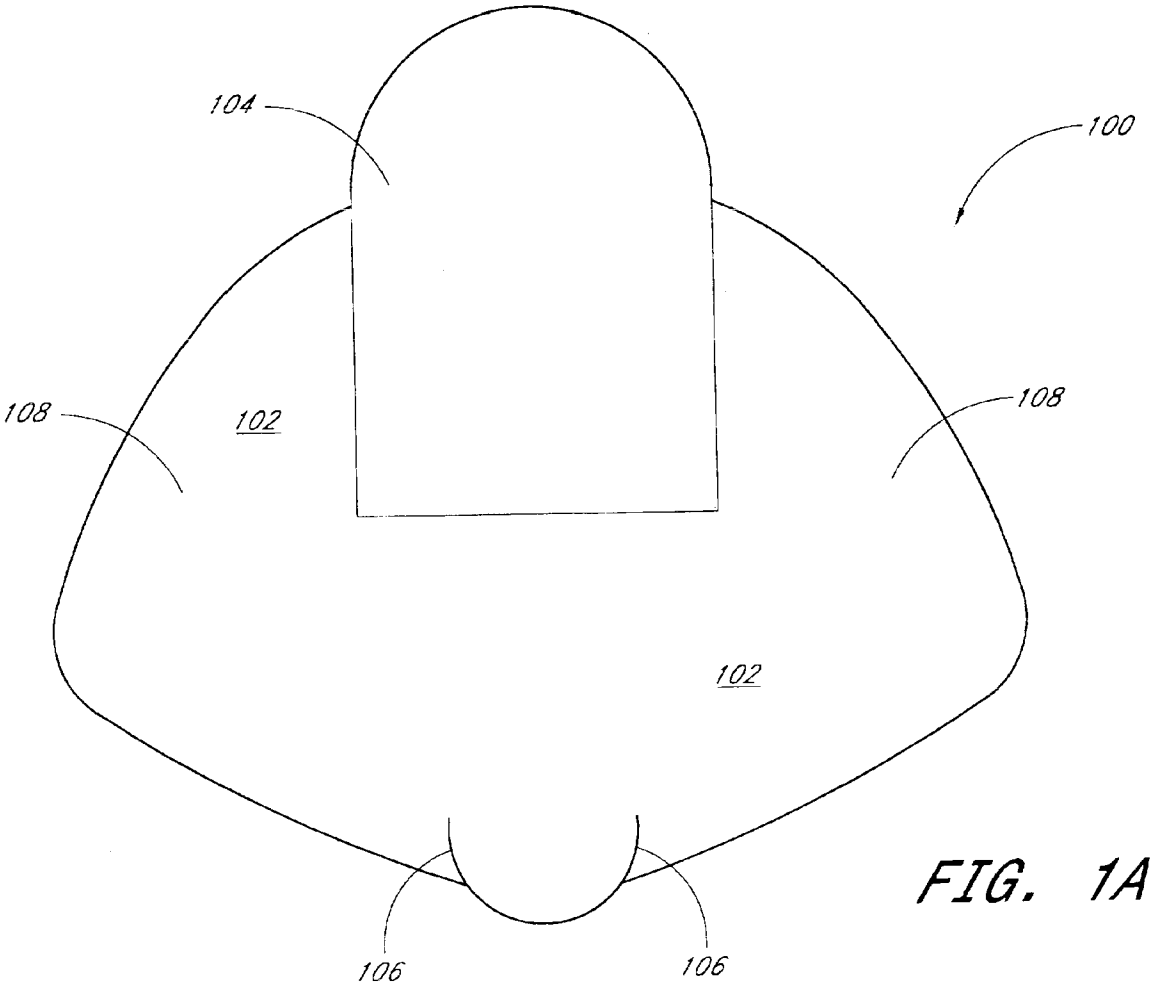
FIG. 1A is a top view of a first example embodiment of inner footwear.
Figure 1B:
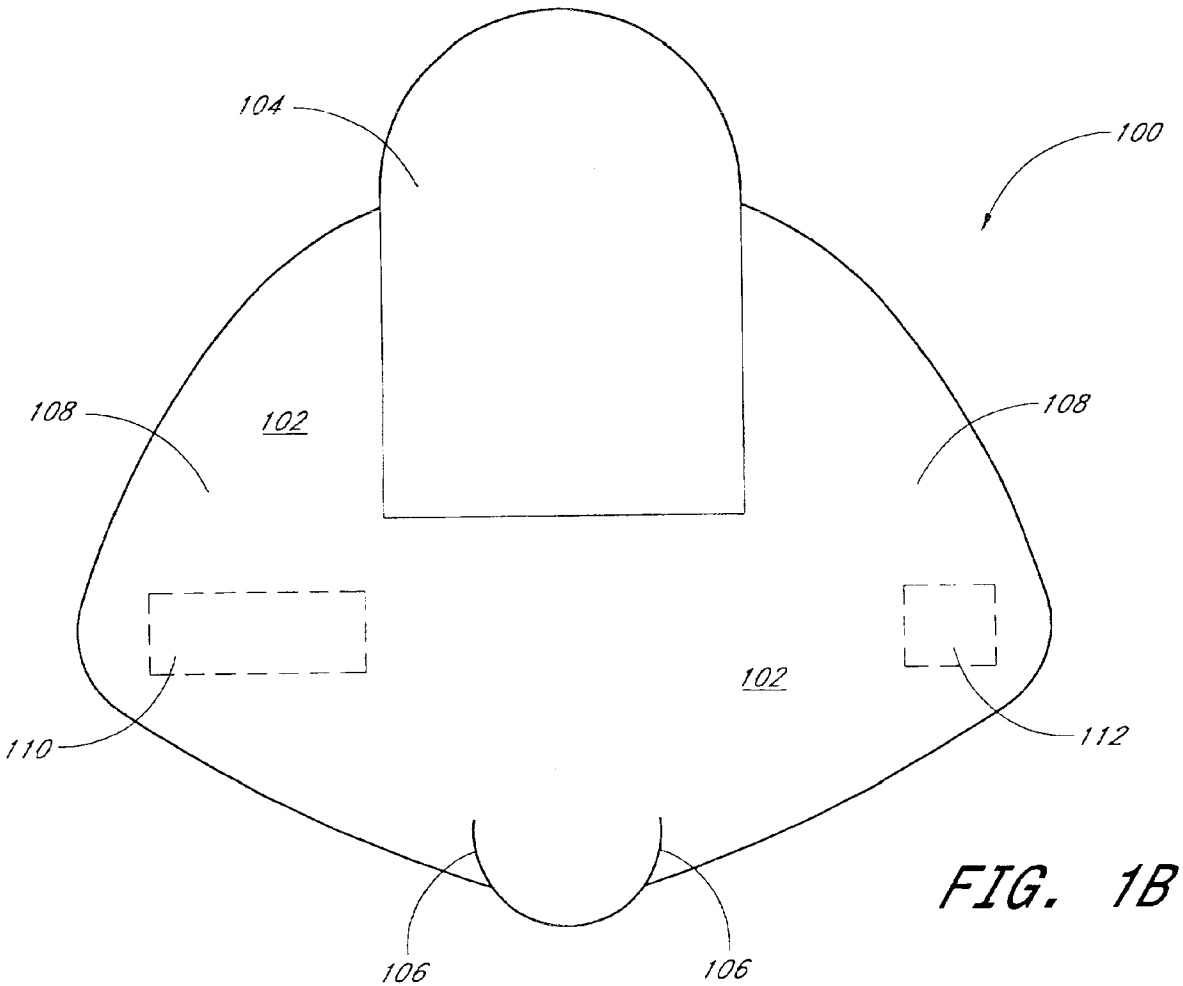
FIG. 1B is a top view of a second example embodiment of inner footwear.

Inner footwear. FIGS. 1A and 1B illustrate exemplary embodiments of inner footwear 100 configured to promote foot beautification. The inner footwear 100 comprises a base region 102, a front pouch 104, heel walls or sidewalls 106, and top flaps 108 outfitted with optional fasteners 110, 112. As discussed below, the top flaps 108 illustrated in FIG. 1A wrap-around the top of the foot and are held in place by a cling effect, and advantageously no fastener is needed. In other embodiments, fasteners can be used. Optional fasteners are illustrated in FIG. 1B.

In one exemplary embodiment, the components of the inner footwear 100 comprise a low cost plastic material that is substantially impermeable or semi-impermeable to cosmetic or therapeutic compounds which may be placed on the feet, thereby providing a structure for keeping the feet in close contact with such materials. Examples of such cosmetic or therapeutic compounds include creams, ointments, locations and other topical medicaments, which are described in greater detail below. In one exemplary embodiment, the various components of the inner footwear 100 are affixed to each other in the arrangement shown by sewing, although in other embodiments other arrangements and other affixation techniques (such as use of an epoxy or a molding process) can be used.

Figure 2:
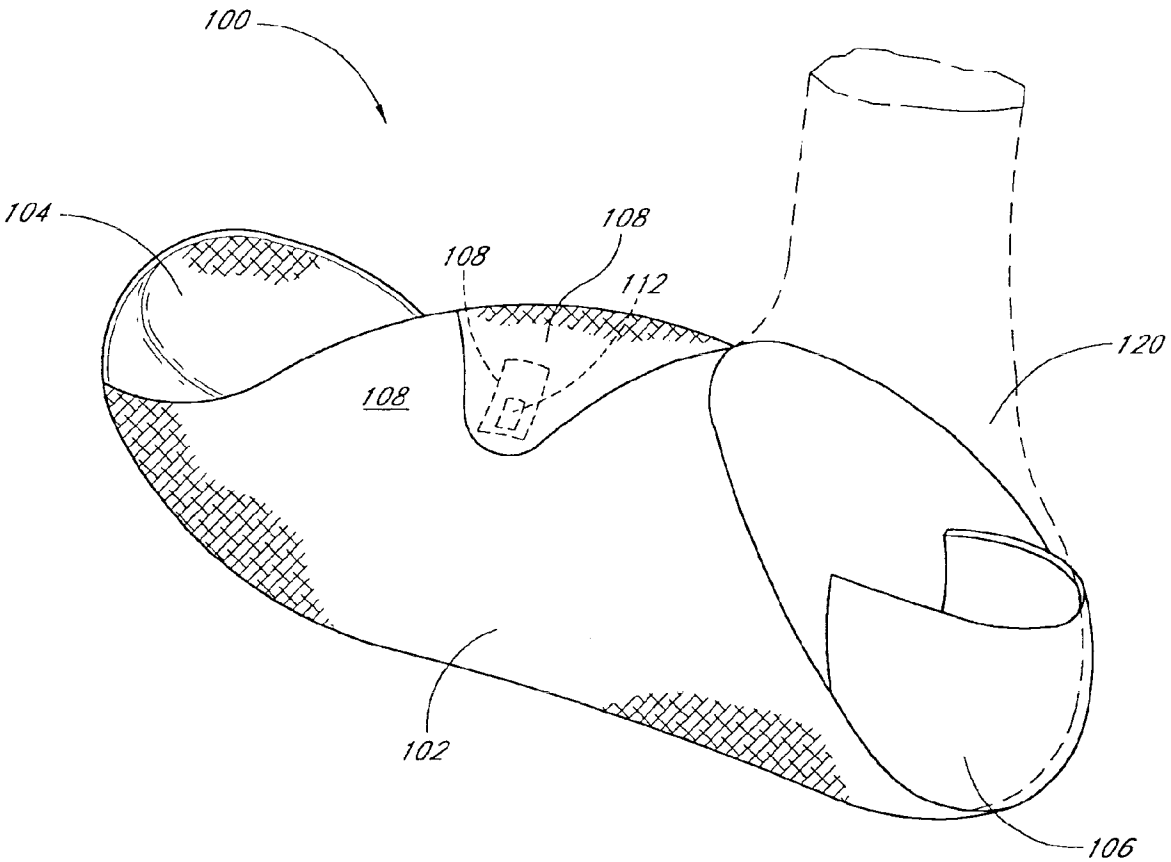
FIG. 2 is a perspective view of the inner footwear of FIG. 1 as worn on a user's foot.

The inner footwear 100 is, for example, dimensioned such that a user can comfortably place his or her foot therein, as illustrated in FIG. 2. Specifically, the inner footwear 100 can be worn by placing one's toes into the front pouch 104 and one's instep over the base region 102, such that one's heel 120 is at least partially surrounded by the heel walls, flaps, or sidewalls 106. In the illustrated embodiment, the front pouch 104 is sized to cover about three-quarters of the top of the foot. In other embodiments the front pouch 104 can be sized to cover more or less of the top of the foot. For example, the front pouch 104 can be sized to cover the user's toes and a small portion of the top of the foot. In one embodiment, the top flaps 108 comprise a polyvinylidene chloride ("PVDC"), Polyvinyl chloride ("PVC)", or other cling film that easily adheres to the top portion of the foot and other portions of the footwear 100 due to static cling, thereby allowing the fasteners to be omitted. The top flaps 108 are wrapped over the top of one's foot and held in place by the cling effect.

If fasteners are used, the top flaps 108 are then wrapped over the top of one's foot, where the fasteners 110, 112, illustrated in FIG. 1B, are secured together.

An ordinarily skilled artisan will recognize that the inner footwear can be manufactured in a variety of sizes, including larger sizes particularly dimensioned for male users, and smaller sizes particularly dimensioned for female users. Optionally, the inner footwear 100 is configured to be "one size fits all" so that the inner footwear will fit a large range of foot sizes. In addition, inner footwear of various sizes can be made to comfortably accommodate men and women with varying foot sizes.

For embodiments where a fastener is used, the fasteners 110, 112 can optionally comprise hook-and-loop type fasteners, which can be quickly and easily opened and closed. One example of a hook-and-loop type fastening system uses Velcro® brand fasteners. In other embodiments, other types of fasteners can be used, such as buttons, snaps or ties. For example, the fasteners 110, 112 allow the top flaps to be secured over the top of the user's foot with a variable tightness, thus allowing the user to adjust the fasteners 110, 112 as desired to enhance comfort. For example, as illustrated in FIG. 2, an optional elongate strip of loop-type fastener 110 is disposed on one of the top flaps, while a small patch of hook-type fastener 112 is disposed on the other top flap, thus allowing the user to adjust the tightness of the top flaps 108 over the foot as desired to enhance comfort.

Figure 4:
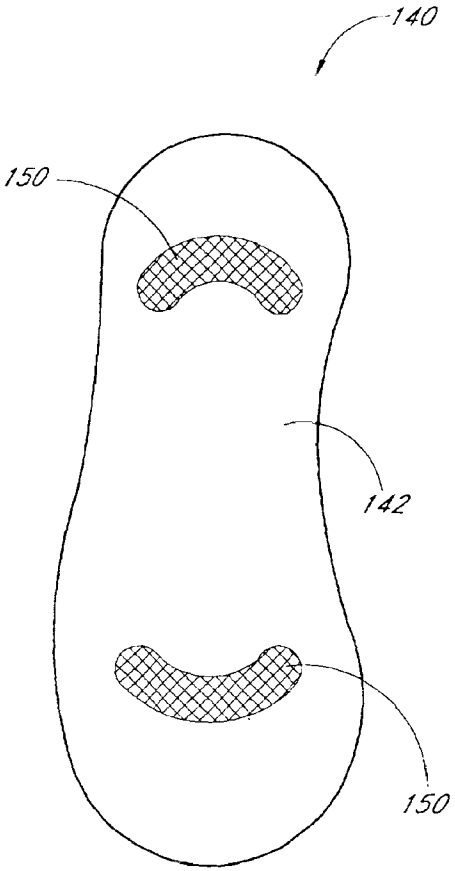
FIG. 4 is a bottom view of the bootie of FIG. 3.
Figure 3:
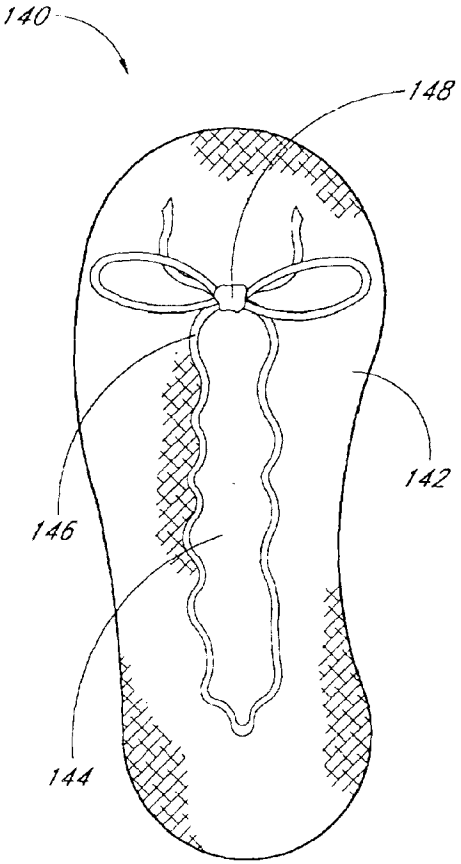
FIG. 3 is a top view of an example of an outer bootie configured to be worn over the inner footwear of FIG. 1.
Figure 5:
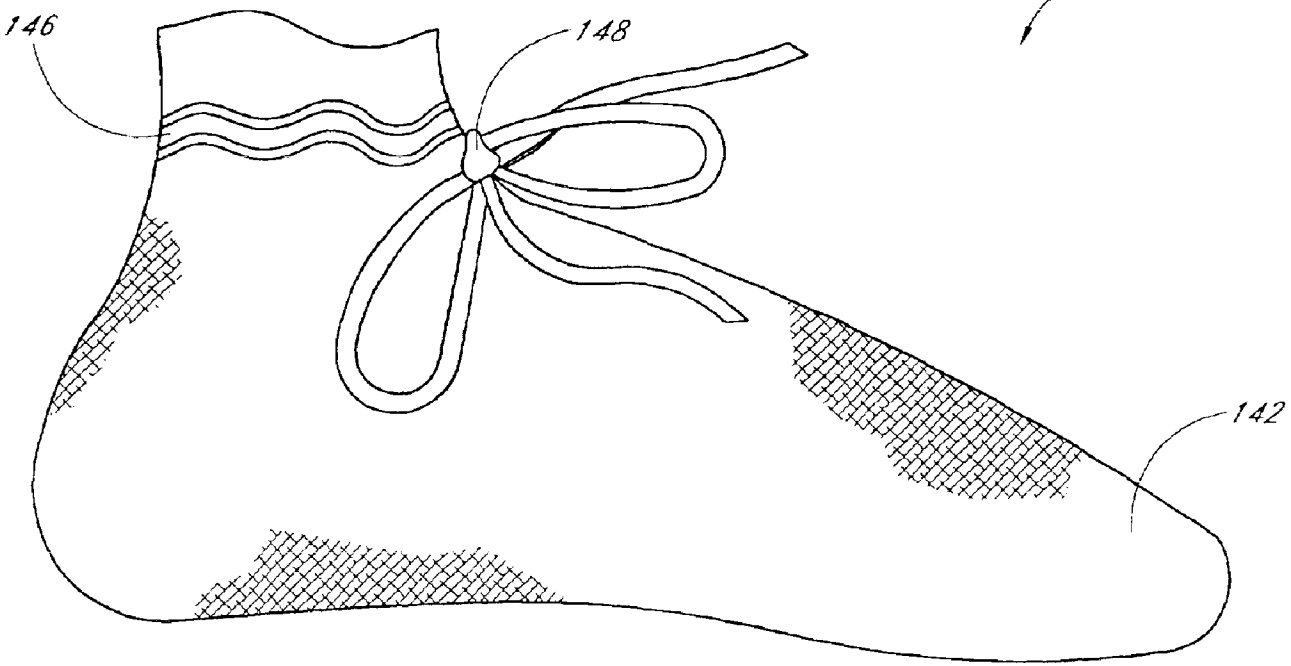
FIG. 5 is a side view of the bootie of FIG. 3 as worn on a user's foot.

Outer footwear. As described above, an exemplary embodiment of the foot beautification system described herein comprises an outer bootie or slipper configured to be positioned over the inner footwear 100, thereby further serving to secure the inner footwear 100 over the user's foot. One example of such an outer bootie is illustrated in FIGS. 3 through 5. Specifically, FIG. 3 illustrates a top view of an exemplary embodiment of an outer bootie 140, while FIGS. 4 and 5 are bottom and side views, respectively. In such embodiments, the outer bootie 140 comprises a body 142 having an adjustable ankle opening 144. In the exemplary embodiment illustrated in FIGS. 3 and 5, the ankle opening 144 is adjustable using drawstring 146 which can be tied in a bow 148. For example, the outer bootie 140 can comprise one or more slip-resistant grips 150, illustrated in FIG. 4, disposed on the underside of the body 142. The body of the outer bootie 140 can comprise a soft fabric, such as mohair, cotton or a durable silk such as raw silk. In other embodiments, other materials can be used, such as wool, polyester or nylon.

The ankle opening 144 can have an adjustable size. Specifically, the ankle opening 144 can be made expandable to allow the user to place his or her foot through the ankle opening 144. At the same time, the ankle opening 144 can be made capable of being cinched up around the user's ankle, or just above or below the user's ankle, thus securing the outer bootie 140 in place, and preventing it from flopping off of the user's foot. One exemplary mechanism for accomplishing thus configuration is using a drawstring 146, which is capable of being tied into a bow 148, as illustrated in FIGS. 3 and 5. In a modified embodiment, the drawstring can be replaced with a decorative ribbon. In other embodiments the ankle opening 144 can be fitted with an elastic strip or any other structure for providing a flexible, expandable opening.

The slip-resistant grips 150, which can be secured to the body 142 using stitching, an epoxy, or any other attachment mechanism, are, for example, comprised of a material having high friction on common flooring surfaces. In one exemplary embodiment, the slip-resistant grips comprise rubber strips that are glued to the outer bootie body 142. For example, the slip-resistant grips can be secured to the portions of the body likely to have the user's weight applied thereto, such as under the balls of the feet and the heel, as illustrated in FIG. 4.

Figure 6:
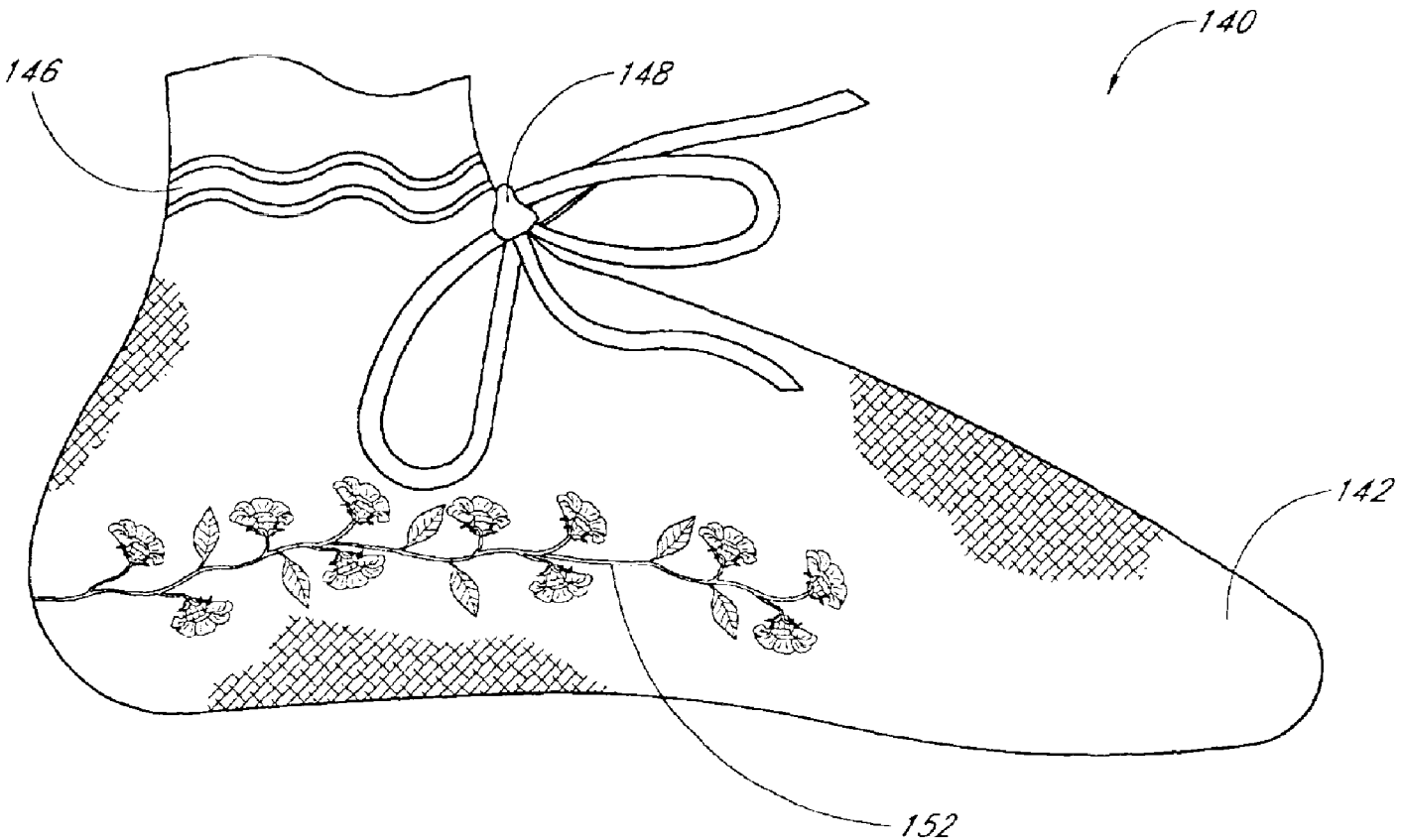
FIG. 6 is a side view of an example of an ornamentally decorated bootie configured to be worn over the inner footwear of FIG. 1.

In a modified embodiment, illustrated in FIG. 6, the outer bootie 140 further comprises ornamental decorations 152 applied thereto. The ornamental decorations 152 can comprise an elegant printed pattern on the body 142, or can comprise material attached to the body 142, such as a feminine ribbon decoration. In such embodiments, the outer bootie 140, including the ankle opening 144, may have a color scheme selected to match the color scheme of the ornamental decorations 152. In other embodiments, the outer bootie 140 can have masculine colors and design cues so at be appeal more to men.

Figure 7:
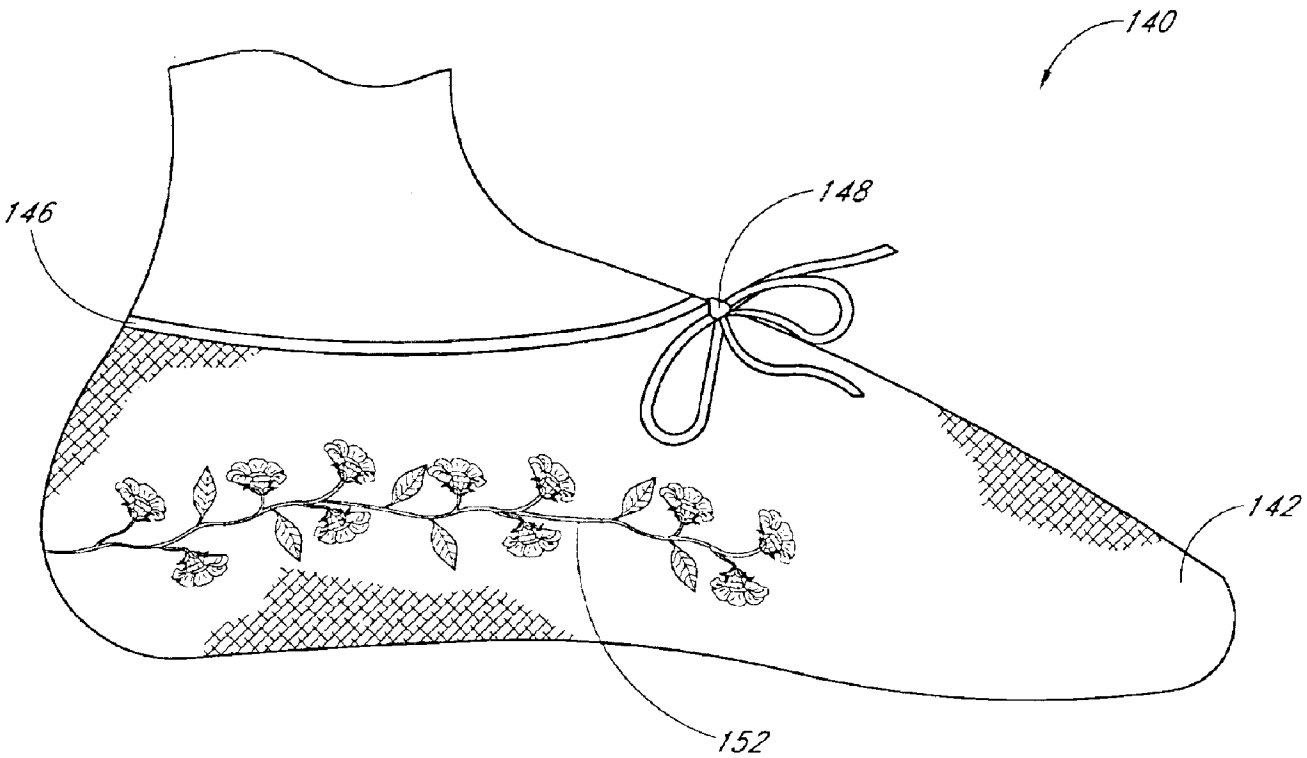
FIG. 7 is a side view of an example of an ornamentally decorated slipper configured to be worn over the inner footwear of FIG. 1.

In still other embodiments, such as illustrated in FIG. 7, an outer slipper 154 can be configured to be worn around a lower portion of the ankle. As described above, a drawstring or other adjustable ankle opening 144 can be used in such embodiments to cinch the ankle opening 144 around the user's foot, although the ankle opening for the outer slipper illustrated in FIG. 7 will be larger than that illustrated in FIG. 6. An outer slipper having a lower cut, such as illustrated in FIG. 7, allows more of the user's skin to be exposed to the air, which facilitates the "breathing" of the skin, and which the user may find more comfortable in warm weather. As discussed above with respect to the bootie 140, the outer slipper 154 can comprise one or more slip-resistant grips disposed on the underside of the slipper 154. The body of the outer slipper 154 can comprise a soft fabric, such as mohair, cotton or a durable silk such as raw silk. In other embodiments, other materials can be used, such as wool, polyester or nylon.

Methods of use. As described above, the various structures described above are adapted for use with a footwear system capable of beautifying the feet and promoting healthy and visually appealing skin on the feet. Specifically, a user can place a topical cosmetic agent on his or her feet, and then place his or her feet into the inner footwear 100. The inner footwear 100 is configured to keep the agent in close contact with the user's feet, thus enhancing the cosmetic effect. In addition, the inner footwear 100 reduces contamination of other articles of clothing, bed linens, or the floor with the cosmetic agent.

Examples of topical agents that can be used with the footwear system described herein include, but are not limited to, water, glycerin, mineral oil, cetaryl alcohol, pertolatum, stearic acid, lecithin, myreth 3-myristate, and DMDM hydantoin. One of ordinary skill in the art will recognize that any number of other cosmetic or therapeutic topical agents can also be used with the footwear system described herein, depending on the particular user's preferences.

After the user's foot is positioned in the inner footwear 100, and the top flaps 108 are secured over the top of the user's foot, the user can then place his or her foot into the outer bootie 140 or slipper 154. As described above, the outer bootie 140 or slipper 154 is configured to secure the inner footwear 100 in place, and to provide an aesthetically pleasing foot covering. The outer bootie 140 or slipper 154, with its slip-resistant grips 150, also facilitates the user's mobility when the inner footwear 100 is disposed over the user's foot. In another embodiment, the outer bootie 140 or slipper 154 can be used as sleepwear, thereby allowing the user to treat his or her feet with a cosmetic or therapeutic compound while sleeping without causing his or her bed linens to become contaminated with the compound.

When the user has completed his or her foot beautification treatment, the outer bootie 140 or slipper 154 can be removed from the foot by opening the ankle opening 144, and the user can withdraw his or her foot from the inner footwear 100. For example, in one embodiment, the inner footwear 100 can be disposable, thus eliminating any need for the user to clean and reuse the inner footwear 100. As described above, the inner footwear 100 can be made from inexpensive materials, thereby rendering a disposable design economically feasible. Because the outer bootie 140 or slipper 154 can be made from durable, washable materials, and because the outer bootie 140 or slipper 154 does not directly contact the cosmetic or therapeutic compounds, the outer bootie/slipper 140 is reusable in an exemplary embodiment.

In certain embodiments, one or more of the footwear components described above (for example, the outer bootie or the outer slipper, and the inner footwear) can be packaged and sold in a kit. In such embodiments, the kit can further include complementary items such as an instruction sheet providing instructions for using the footwear systems described herein, or additional lotions for use on the feet. The instruction sheet can be a paper sheet containing guidelines for using the footwear systems described herein, or can comprise an audio or video informational presentation about such systems, that could, for example, illustrate their use. Such an audio or video system could be delivered, for example, on a compact disc, a videocassette, a digital video disc, or any other information storage medium. In other embodiments, the various components of the footwear systems described herein can be packaged and sold separately.

As described herein, the feet beautification systems described herein provide an effective way for users to promote soft, healthy and attractive skin on their feet. In particular, the systems described herein can easily be used to pamper and rejuvenate foot skin. This can be done using topical agents such as lotions, creams and ointments, without risking contamination of surfaces such as bed linens, clothing and floors with such agents. Specifically, by providing a contained system for applying such agents, the user is free to perform other activities, such as lounging or sleeping, simultaneous with the application of such agents. In embodiments wherein the outer bootie or slipper includes ornamental decorations, the user is further provided with attractive outer footwear.

It should be understood that certain variations and modifications of this invention would suggest themselves to one of ordinary skill in the art. The scope of the present invention is not to be limited by the illustrations or the foregoing descriptions thereof.

What is claimed is:

1. A foot beautification kit comprising:

a disposable inner footwear adapted for receiving a foot, the inner footwear made from a plastic material and having a toe portion, a heel portion, and an upper foot covering portion adapted to be wrapped over an upper surface of the foot, the inner footwear configured to hold a topical agent in close contact with the skin of the foot;

a foot lotion configured to provide a therapeutic effect on the skin of the foot;

outer footwear configured to be placed over the inner footwear, the outer footwear having an adjustable-width ankle opening configured to wrap around an upper portion of the foot; and instructions for using the inner footwear and the outer footwear to beautify at least one foot by placing a lotion on the foot, and then placing the foot in the inner footwear and the outer footwear.

2. A foot beautification kit comprising:

a disposable inner footwear adapted for receiving a foot, the inner footwear made from a plastic material and having a toe portion, a heel portion, and an upper foot covering portion adapted to be wrapped over an upper surface of the foot, the inner footwear configured to hold a topical agent in close contact with the skin of the foot;

a foot lotion configured to enhance the cosmetic appearance of the skin of the foot;

outer footwear configured to be placed over the inner footwear, the outer footwear having an adjustable-width ankle opening configured to wrap around an upper portion of the foot; and instructions for using the inner footwear and the outer footwear to beautify at least one foot by placing a lotion on the foot, and then placing the foot in the inner footwear and the outer footwear.

3. The foot beautification kit of claim 1, wherein the outer footwear is one of a bootie and a slipper, and further comprises an ornamental design.

4. The foot beautification kit of claim 1, wherein the plurality of top flaps are comprised at least in part of a cling material.

5. The foot beautification kit of claim 1, wherein the plurality of top flaps have disposed thereon a fastener configured to secure the plurality of top flaps together over the upper portion of the foot.

6. The foot beautification kit of claim 1, wherein the adjustable-width ankle opening comprises a drawstring.

7. The foot beautification kit of claim 6, wherein the drawstring comprises a decorative ribbon.

8. The foot beautification kit of claim 1, wherein the adjustable-width ankle opening comprises an elastic band.

9. The foot beautification kit of claim 2, wherein the outer footwear is one of a bootie and a slipper, and further comprises an ornamental design.

10. The foot beautification kit of claim 2, wherein the plurality of top flaps are comprised at least in part of a cling material.

11. The foot beautification kit of claim 2, wherein the plurality of top flaps have disposed thereon a fastener configured to secure the plurality of top flaps together over the upper portion of the foot.

12. The foot beautification kit of claim 2, wherein the adjustable-width ankle opening comprises a drawstring.

13. The foot beautification kit of claim 2, wherein the drawstring comprises a decorative ribbon.

14. The foot beautification kit of claim 2, wherein the adjustable-width ankle opening comprises an elastic band.

* * * * *